US007296961B2

(12) United States Patent
Segerljung

(10) Patent No.: US 7,296,961 B2
(45) Date of Patent: Nov. 20, 2007

(54) DEVICE FOR POWER TRANSMISSION IN A WORKING MACHINE

(75) Inventor: Max Segerljung, Vännäs (SE)

(73) Assignee: Stock of Sweden, Stromsund (SE)

( * ) Notice: Subject to any disclaimer, the term of this patent is extended or adjusted under 35 U.S.C. 154(b) by 184 days.

(21) Appl. No.: 10/521,542

(22) PCT Filed: Jun. 23, 2003

(86) PCT No.: PCT/SE03/01072

§ 371 (c)(1),
(2), (4) Date: Jan. 14, 2005

(87) PCT Pub. No.: WO2004/007338

PCT Pub. Date: Jan. 22, 2004

(65) Prior Publication Data

US 2006/0130474 A1 Jun. 22, 2006

(30) Foreign Application Priority Data

Jul. 15, 2002 (SE) ..... 02022069

(51) Int. Cl.
*E02F 3/96* (2006.01)

(52) U.S. Cl. ..... 414/685; 37/468; 414/723

(58) Field of Classification Search ..... 414/685, 414/703, 708, 723; 187/222, 237; 91/173, 91/176; 60/476; 37/468
See application file for complete search history.

(56) References Cited

U.S. PATENT DOCUMENTS

| | | | | |
|---|---|---|---|---|
| 2,795,346 | A | 6/1957 | Farmer | |
| 3,184,088 | A | 5/1965 | Berge | |
| 3,738,520 | A | 6/1973 | Didtel et al. | |
| 4,775,288 | A * | 10/1988 | Dimitriu | 414/708 |

FOREIGN PATENT DOCUMENTS

| | | |
|---|---|---|
| FR | 1317499 | 1/1963 |
| SE | 434880 | 8/1984 |
| WO | 95/02552 | 1/1995 |

* cited by examiner

*Primary Examiner*—Donald Underwood
(74) *Attorney, Agent, or Firm*—Dilworth & Barrese LLP.

(57) ABSTRACT

A device to transmit power from the power system of a working machine to one or more moving parts (25, 26) of a tool replaceably attachable to a first part of the working machine which is in the form of a beam, or such, comprising a first element (7) arranged on the working machine and driven by its power system, a second element (11) movably attached to the tool and means (8, 12) arranged to mechanically interconnect both of said elements so that a displacement of the first element via the working machine's power system brings about a movement of the second element on the tool.

19 Claims, 3 Drawing Sheets

DEVICE FOR POWER TRANSMISSION IN A WORKING MACHINE

BACKGROUND OF THE INVENTION AND PRIOR ART STATEMENT

The present invention concerns a device to transmit power from the power system of a working machine to one or more moving parts of a tool replaceably attachable on a first part of the working machine which is in the form of a beam or such.

The working machine can be of any type and trucks, front loaders, digging machines and demolition machines can be mentioned as examples, which are generally supplied with different types of tools. The term "tool" also includes so-called working instruments, and examples of what is here intended to be thought of as tools are forks of different types, scoops, man-baskets, lever arms and other special equipment for handling special loads.

In order to illustrate the invention but without limiting the invention, the case of a tool in the form of a fork unit can be briefly described. Such a fork unit is used for the handling of pallets and other such goods. The fork unit is usually expected to have different functions which require some kind of driving, i.e. the unit has to be supplied with power (energy). Examples of such functions are that the forks could be driven apart or moved together depending on what kind of load is to be handled or that they could be laterally moved relative to a frame of the fork unit. The power required to carry out these functions is obtained by the fork unit from the working machine's power system according to known devices of the type defined in the introduction, usually a hydraulic system, since this device has components to rapidly interconnect the working machine's hydraulic system with a hydraulic cylinder arranged on the tool to carry out said functions.

This means that when a change of the tool on the working machine is desired the driver has to get out of the driver's cabin and manually interconnect said components for interconnection of the truck's hydraulic system with one or more hydraulic cylinders on the tool. This can be troublesome for the driver, and he can therefore sometimes be tempted to neglect to change the tool if this is not absolutely necessary and instead use an unsuitable tool. This can in its turn result in the risk of injury.

Another disadvantage with such known devices and this way of interconnecting the working machines hydraulic system with hydraulic cylinders on the tool lies in the fact that there are no such connection components that are completely protected against impurities in the hydraulic oil. This constitutes a decreasing operation safety factor as the use of proportional valves in hydraulic systems increases.

SUMMARY OF THE INVENTION

The aim of the present invention is to provide a device of the type defined in the introduction, which makes it possible to at least partly remedy the above-mentioned inconveniences.

This aim is achieved according to the invention by providing such a device, that comprises a first element arranged on the working machine and driven by its power system, a second element movably attached to the tool and means arranged to mechanically interconnect both of said elements so that a displacement of the first element via the working machine's power system brings about a movement of the second element on the tool.

By mechanically interconnecting the working machine's power system with the tool in this way the above-mentioned impurities in the hydraulic liquid, or such, of the working machine's power system can be totally eliminated. Therefore in the case of a pressure medium system, such as a hydraulic system, as the power system of the working machine, the pressure medium will not be exposed to the surroundings in any way by transfer to pressure medium cylinders of the tool via openable rapid connection components. The working machine's hydraulic system can therefore be held entirely closed relative to the external environment.

Another advantage with the inventive device is that by using a mechanical power transmission between the working machine and the tool it offers the possibility to achieve an automatic connection of the working machine's power system to the tool on testing the tool in said first part of the working machine, so that in the case where the attachment itself is of the rapid attachment type the driver does not have to get out of the driver's cabin to change the tool, so that a tool change will be considered to be simple and the risk of the driver omitting to change the tool will therefore be significantly reduced. A device according to a preferred embodiment of the invention provides this possibility in that said means for mechanical interconnection are arranged to automatically establish a mechanical interconnection of the first and second elements on attachment of the tool to the working machine's first part.

According to another preferred embodiment of the invention, which constitutes a development of the previous embodiment, the means for mechanical interconnection comprise engagement means on the first and second element, which are arranged to co-operate with one another to automatically move into power-transmitting engagement with one another on attachment of the tool to said first part. By using such engagement means, that can for example be made of a projection of one element and a recess arranged to receive the projection on the other, the mechanical interconnection can be simply realized on moving the tool and said first part together.

"Recess" should be understood to have a broad meaning and includes every type of indentation, or such, that can form a power-transmitting seating for a projection, for example such as a U-formed cradle arranged to receive a projection between the sides of the U so that power can then be transmitted between these sides and the projection. This type of recess makes the establishment of the mechanical interconnection very simple without requiring high precision work.

According to another preferred embodiment of the invention said second element is arranged to operate a drive unit to set parts of the tool into motion relative to a body of the tool on displacement of the second element relative to the body of the tool, and the second element is connected to a second pressure medium cylinder on the tool, which lacks a power supply through any pressure medium source, to cause movement of the piston of this second cylinder relative to a casing of the cylinder by movement of the first element. In this way a drive unit that works with pressure medium is provided on the tool and works in the same way as if the working machine's pressure medium system were directly connected thereto, despite the fact that both systems will be totally separated from each other as regards the communication of pressure medium.

It is thereby therefore possible, and even the subject of a further preferred embodiment of the invention, that the second pressure medium cylinder is arranged to function as a pump to drive one or more additional pressure medium cylinders arranged on the tool, which are in pressure medium flow communication with the second cylinder. The pump can for example hereby power a cylinder for the respective fork of a tool in the form of a fork unit to move the forks relative to a body of the tool. Both of the additional pressure medium cylinders can thereby advantageously have internally interconnected pressure medium chambers to make a movement of one of the forks dependent on a movement of the other fork, so that via movement of the first element, and thereby the second element, both of the forks can either move in opposite directions, apart or together, or in the same direction for lateral displacement relative to a body of the tool.

Further advantages as well as advantageous features of the invention will be apparent from the following description; and

BRIEF DESCRIPTION OF THE DRAWINGS

A preferred embodiment of the invention is described below as an example with reference to the attached drawings, in which.

DETAILED DESCRIPTION OF A PREFERRED EMBODIMENT OF THE INVENTION

Figure 1A:
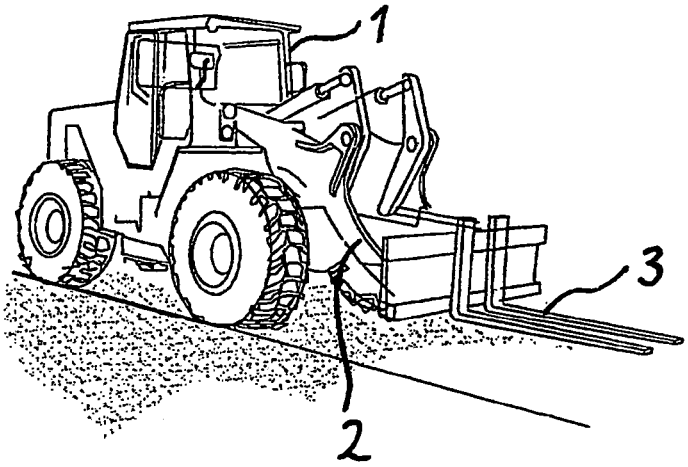
FIGS. 1*a*, 1*b* and 1*c* illustrate a conventional working machine with examples of some instruments, on which an inventive power transmission device could be applied.
Figure 1B:
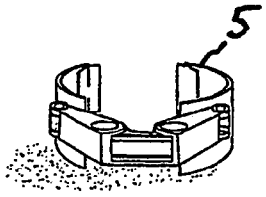
Figure 1C:
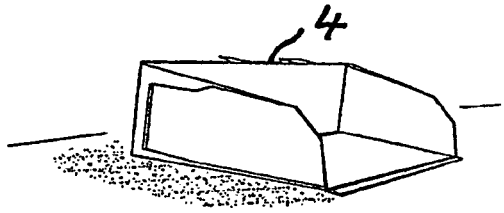

FIG. 1 illustrates a working machine 1 in the form of a front loader as well as some of a number of different possible tools and instruments that could be attached to the machine's arms 2 and obtain power from the working machine's power system via an inventive device. A fork unit 3, a scoop 4 and a clamping unit 5 are shown here.

Figure 2:
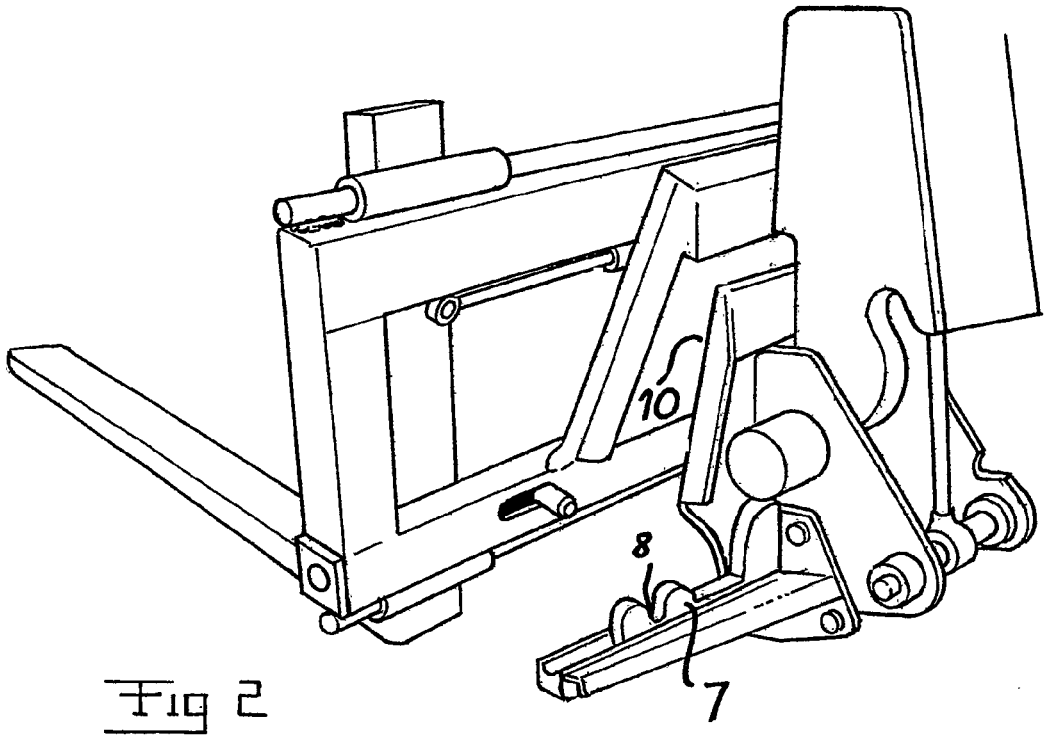
FIG. 2 is a perspective view, which illustrates how an interconnection between a working machine and a tool takes place in a device according to a preferred embodiment of the invention.
Figure 3:
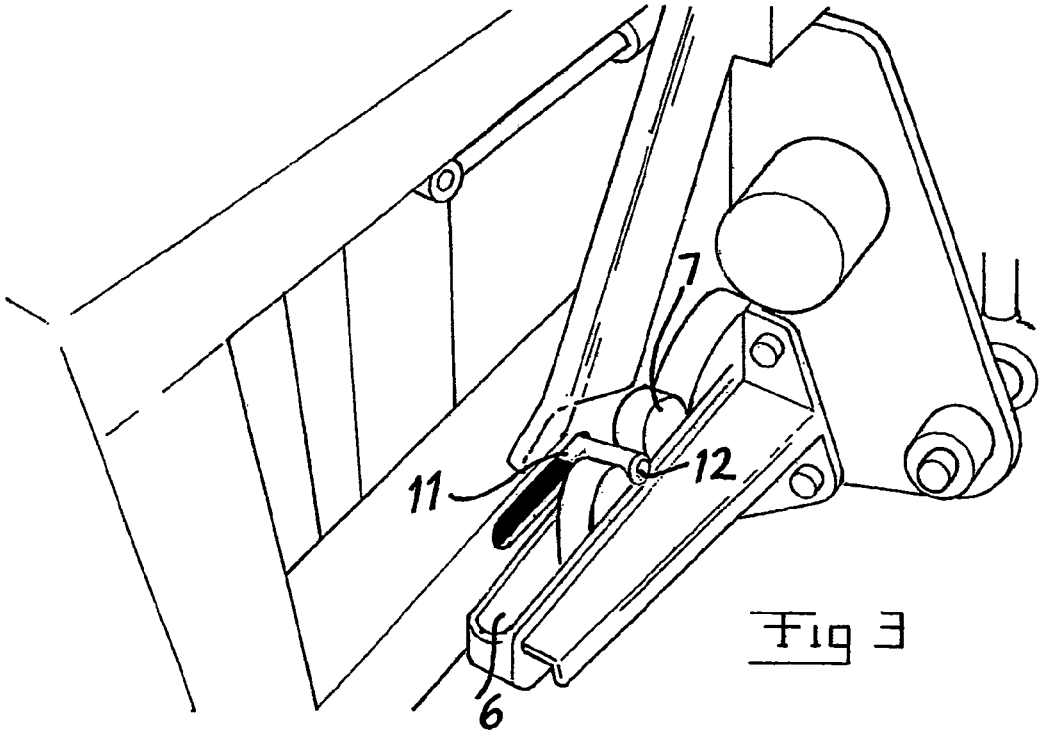
FIG. 3 is a perspective view of part of the inventive device in interconnected position.
Figure 4:
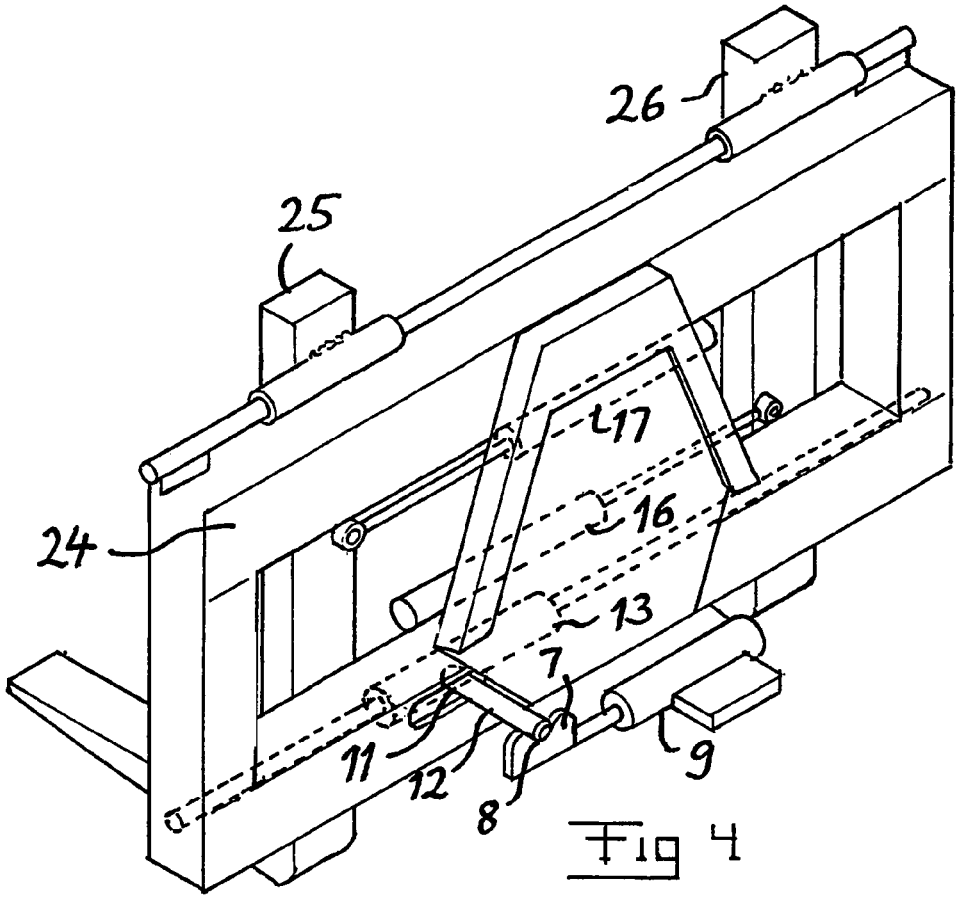
FIG. 4 is a perspective view of the inventive device applied on a fork unit, where bulky parts of the working machine have been left out.

A device according to a preferred embodiment of the invention for transmitting power from a power system, of such a working machine to one or more moving parts of a tool replaceably attachable on a first part, such as the arm 2 or a beam, of the working machine, will now be described with simultaneous reference to FIGS. 2-4.

The device has a first element 7 arranged on the end of the working machine's first part and which can be driven into motion along a track 6 by the working machine's power system. This element is provided with a recess 8 in the form of an upwardly open U-shaped cradle. In order to achieve this movement the device comprises a pressure medium cylinder 9 arranged on said first part near an attachment arrangement for the tool, and connected to the working machine's power system. The first element 7 is connected to the hydraulic cylinder's piston rod and is movable transversely in the direction of attachment of the tool on the arm via a schematically indicated attachment device 10, which will not be described in more detail.

The device additionally has a second element 11 movably arranged on the tool with a rod-like projection 12 arranged thereupon so that on attachment of the tool to the working machine it is in such an initial position that it is automatically "docked" in the cradle's recess 8 which is driven upwards from below onto the projection. Mechanical interconnection is in this way established by the first element with the second, so that a movement of the first element 7 results in a corresponding movement of the second element on the tool.

Figure 5:
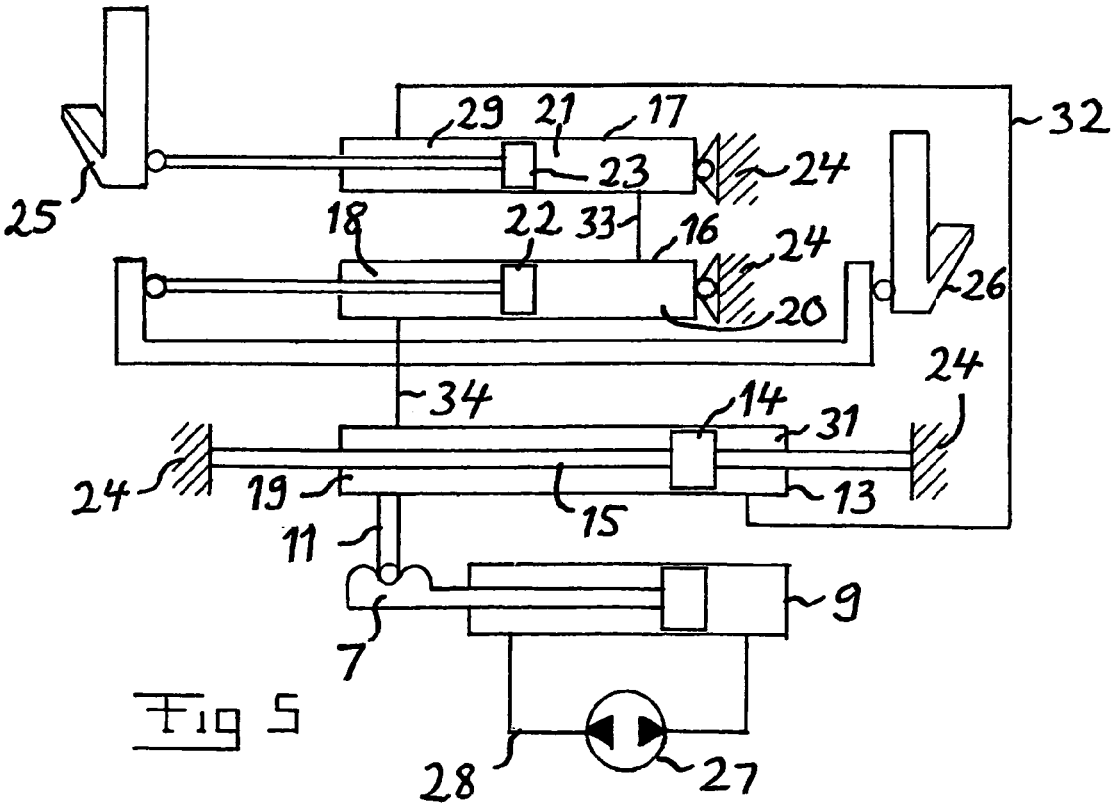
FIG. 5 is a simplified sketch illustrating the principle function of the device in FIG. 4.

Reference is now made to FIG. 5. The second element 11 is connected to a second pressure medium cylinder 13 by being fixedly attached to its cylinder wall and arranged to provide movement of a piston of this cylinder relative to the casing 13 by moving the casing relative to a piston rod that goes through the casing. This second hydraulic cylinder is arranged to function as a pump to drive one or more additional pressure medium cylinders 16, 17, which are in pressure medium flow communication with the second cylinder, more particularly so that one of the cylinders 16 has a chamber 18 connected with a chamber 19 of the second cylinder 13 via connection 34 and the second chamber 20 is connected with a chamber 21 of the cylinder 17 via connection 33. The pump cylinder 13 will hereby on movement of its piston 14 relative to the casing cause movement of the piston 22, 23, in both of the additional cylinders 16, 17. Each additional cylinder is arranged to function between points on a frame 24 of the tool and a fork 25, 26 that is displaceably received in the frame's transverse direction.

The function of the inventive device that has just been described above is the following: when the hydraulic pump 27 of the working machine's hydraulic system 28 is powered to move the piston of the device's hydraulic cylinder 9, the first element 7 will then be displaced and thereby even displace the second element 11. We assume now that the hydraulic cylinder's 9 piston moves to the right in FIG. 5. This means that the casing of hydraulic cylinder 13 is displaced to the right relative to the piston 14 and hydraulic liquid is thereby pumped from the chamber 19 into the hydraulic cylinder's 16 chamber 18 to displace the fork 26 to the right. This means that hydraulic liquid is simultaneously transmitted from cylinder 16 to the chamber 21 of the cylinder 17, so that the piston 23 and thereby the fork 25 are displaced to the left. Hydraulic liquid, that is thereby squeezed out of the cylinder's 17 chamber 29, will be conveyed into the chamber 31 of the pump cylinder via the connection conduit 32. Consequently both forks will move apart. If the movement of the driving cylinder 9 is reversed, the forks 25, 26 will move towards each other.

Instead of having the connection 33 between the chamber 20 of the cylinder 16 and the chamber 21 of the cylinder 17 and the connection 34 between the pump cylinder's chamber 19 and the cylinder's 16 chamber 18, these connections could be modified so that the forks 25, 26 would instead always be displaced in the same direction for lateral displacement of the forks.

The invention is of course not in any way limited to the preferred embodiment described above, but a number of modification possibilities should be apparent for a person skilled in the art, without that person having to deviate from the basic idea of the invention.

For example a male-type interconnecting means could well be arranged on the first element and a female-type interconnecting means could be arranged on the second element.

"To mechanically interconnect" as used above and in the attached claims should be interpreted as if there is a mechanical connection between both elements so that a movement of one of the elements automatically results in the movement of the other. However it would be possible to provide mechanical interconnection by using "non-mechanical" means, such as a permanent magnet on the first element arranged to be forced towards a piece of suitable material on the second element to lock these relative to one another. The definition used covers such cases.

Other types of movement rather than the straight-line movement that has been illustrated above are of course possible to achieve with an inventive device. For example the first element could cause a gear wheel or such on the tool to rotate via a mechanical connecting means. Even other movement patterns would be possible.

The invention claimed is:

1. Device to transmit power from a power system (28) of a working machine (1) to one or more moving parts (25, 26) of a tool (3-5) replaceably attachable to a first part of the working machine which is in the form of a beam, comprising a first element (7) arranged on the working machine and driven by its power system, a second element (11) movably coupled either directly or through at least one interconnecting component to the tool (3-5), and means (8, 12) arranged to mechanically interconnect both of said elements (7, 11) so that a displacement of the first element (7) via the working machine's power system brings about a movement of the second element (11) and the tool (3-5), wherein said means (8, 12) for mechanical interconnection is arranged to automatically establish a mechanical interconnection of the first (7) and second (11) elements on attachment of the tool to the working machine's first part.

2. Device according to claim 1, wherein the means for mechanical interconnection comprise engagement means (8, 12) on the first and second elements, which are arranged to co-operate with each other to automatically establish power-transmitting engagement with each another on attachment of the tool to said first part.

3. Device according to claim 2, wherein one of the engagement means is formed from a projection (12) arranged on the first element and the other engagement means is formed from a recess (8) arranged on the second element and arranged to receive the projection on moving the tool and the first part together.

4. Device according to claim 1, wherein the second element (11)is displaceably arranged in a track on the tool via power transmission from the first element (7).

5. Device according to claim 1, additionally comprising elements (13, 16, 17) for interconnection of the second element (11) with said moving parts (25, 26) of the tool to transmit a movement of the second element (11) to a movement of these tool parts (15, 26).

6. Device according to claim 1, additionally comprising a pressure medium cylinder (9) arranged on said first part of the working machine near an attachment arrangement for the tool, and connected to the working machine's power system (28), and said first element (7) is formed from, or connected to, a part of said cylinder (9) that is movably arranged relative to the first part.

7. Device according to claim 6, wherein the first element (7) is formed from an end of a piston rod of the cylinder which is distant from the piston.

8. Device according to claim 6, wherein the pressure medium cylinder (9) is a hydraulic cylinder connected to the working machine's power system (28) that is in the form of a hydraulic system.

9. Device to transmit power from a power system (28) of a working machine (1) to one or more moving parts (25, 26) of a tool (3-5) replaceably attachable to a first part of the working machine which is in the form of a beam, comprising a first element (7) arranged on the working machine and driven by its power system, a second element (11) movably coupled either directly or through at least one interconnecting component to the tool (3-5), means (8, 12) arranged to mechanically interconnect both of said elements (7, 11) in the absence of hydraulics so that a displacement of the first element (7) via the working machine's power system brings about a movement of the second element on (11) and the tool (3-5), and a drive unit coupled to the movable parts (23, 26) of the tool to set the parts (25, 26) of the tool into motion relative to a body (24) of the tool, wherein said second element (11) is coupled to the drive unit such that on displacement of the second element (11) relative to the body (24) of the tool, the movable parts (25, 26) are set in motion.

10. Device according to claim 9, wherein said second element (11) is connected to a pressure medium cylinder (13) on the tool, which lacks a power supply through any pressure medium source to cause movement of the piston (14) of this cylinder relative to a casing of the cylinder by movement of the first element (7).

11. Device to transmit power from a power system (28) of a working machine (1) to one or more moving parts (25, 26) of a tool (3-5) replaceably attachable to a first part of the working machine which is in the form of a beam, comprising a first element (7) arranged on the working machine and driven by its power system, a second element (11) movably coupled either directly or through at least one interconnecting component to the tool (3-5), means (8, 12) arranged to mechanically interconnect both of said elements (7, 11) so that a displacement of the first element (7) via the working machine's power system brings about a movement of the second element (11) and the tool (3-5), a drive unit coupled to the movable parts (25, 26) of the tool to set the parts (25, 26) of the tool into motion relative to a body (24) of the tool, wherein said second element (11) is coupled to the drive unit such that on displacement of the second element (11) relative to the body (24) of the tool, the movable parts (25, 26) are set in motion, and connected to a pressure medium cylinder (13) on the tool, which lacks a power supply through any pressure medium source to cause movement of the piston (14) of this cylinder relative to a casing of the cylinder by movement of the first element (7), and the pressure medium cylinder (13) is arranged to function as a pump to drive one or more additional pressure medium cylinders (16, 17) arranged on the tool, which are in pressure medium flow communication with the cylinder.

12. Device to transmit power from a power system (28) of a working machine (1) to one or more moving parts (25, 26) of a tool (3-5) replaceably attachable to a first part of the working machine which is in the form of a beam, comprising a first element (7) arranged on the working machine and driven by its power system, a second element (11) movably coupled either directly or through at least one interconnecting component to the tool (3-5), means (8, 12) arranged to mechanically interconnect both of said elements (7, 11) so that a displacement of the first element (7) via the working machine's power system brings about a movement of the second element (11) and the tool (3-5), and elements (13, 16, 17) for interconnection of the second element (11) with said moving parts (25, 26) of the tool (3-5) to transmit a movement of the second element to a movement of these tool parts (25, 26), wherein the tool is a fork unit with the moving parts comprising forks (25, 26) that are laterally displaceable along a frame (24), and the interconnection elements (13, 16, 17) transmit a movement of the second element (11) to a movement of the forks.

13. Device according to claim 11, additionally comprising two additional pressure medium cylinders (16, 17) for each driving a respective fork (25, 26) which constitute the movable parts.

14. Device according to claim 13, wherein both of said additional pressure medium cylinders (16, 17) have mutually interconnected pressure medium chambers and means for interconnecting the same to make a movement of one fork (25) dependent on a movement of the other fork (26).

15. Device according to claim 14, wherein said means interconnect said additional pressure medium cylinders (16, 17) to cause a displacement of the forks (25, 26) in opposite directions for separating or bringing them together relative to each other via movement of the second element (11).

16. Device according to claim 14, wherein said means interconnect both of said additional pressure medium cylinders (16, 17) to cause a displacement of the forks (25, 26) in the same direction for simultaneous displacement thereof to one side or the other of a body of the tool via movement of the second element (11).

17. Device according to claim 2, wherein the second element (11) is displaceably arranged in a track on the tool via power transmission from the first element (7).

18. Device according to claim 3, wherein the second element (11) is displaceably arranged in a track on the tool via power transmission from the first element (7).

19. Device according to claim 18, additionally comprising elements (13, 16, 17) for interconnection of the second element (11) with said moving parts (25, 26) of the tool to transmit a movement of the second element (11) to a movement of these tool parts.

* * * * *